US006108991A

United States Patent [19]

Hagan et al.

[11] Patent Number: 6,108,991

[45] **Date of Patent: *Aug. 29, 2000**

[54] EXTERIOR WALL ASSEMBLY

[75] Inventors: Joseph R. Hagan, Pinellas County, Fla.; Kim K. DeVormer, Barry County, Mich.; Fred H. Hansen, Broward County, Fla.

[73] Assignee: Celotex Corporation, Tampa, Fla.

[ * ] Notice: This patent is subject to a terminal disclaimer.

[21] Appl. No.: 09/165,187

[22] Filed: Oct. 2, 1998

Related U.S. Application Data

[63] Continuation-in-part of application No. 08/792,597, Jan. 31, 1997, Pat. No. 5,836,135.

[51] Int. Cl.[7] ..... E04B 1/70; E04F 17/00

[52] U.S. Cl. ..... 52/302.3; 52/58; 52/302.6; 52/506.01

[58] Field of Search ..... 52/58, 169.5, 302.1, 52/302.3, 302.6, 506.1, 612, 730.1; 405/36, 39, 43, 45

[56] References Cited

U.S. PATENT DOCUMENTS

| | | | |
|---|---|---|---|
| 1,976,166 | 10/1934 | Friedberg . | |
| 2,264,961 | 12/1941 | Ward . | |
| 2,645,824 | 7/1953 | Titsworth . | |
| 2,703,002 | 3/1955 | Suskind . | |
| 3,850,193 | 11/1974 | Guzzo . | |
| 4,569,872 | 2/1986 | Miller . | |
| 4,570,398 | 2/1986 | Zimmerman . | |
| 4,745,716 | 5/1988 | Kuypers . | |
| 4,773,195 | 9/1988 | Waller . | |
| 4,837,991 | 6/1989 | Shaw . | |
| 4,869,032 | 9/1989 | Geske . | |
| 5,363,621 | 11/1994 | Kroll et al. . | |
| 5,392,578 | 2/1995 | Kroll et al. . | |
| 5,501,044 | 3/1996 | Janesky . | |
| 5,511,346 | 4/1996 | Kenworthy . | |
| 5,519,969 | 5/1996 | Golba . | |
| 5,564,243 | 10/1996 | Kroll et al. . | |
| 5,836,135 | 11/1998 | Hagan et al. | 52/730.1 |

FOREIGN PATENT DOCUMENTS

| | | |
|---|---|---|
| 2854099 | 7/1980 | Germany . |
| 8810264 | 11/1988 | Germany . |
| 19626422 | 1/1998 | Germany . |

*Primary Examiner*—Carl D. Friedman
*Assistant Examiner*—Kevin D. Wilkens
*Attorney, Agent, or Firm*—Charles W. Vanecek

[57] ABSTRACT

An exterior wall assembly comprising an outer weather-resistant layer, a heat insulating panel situated interiorly to the outer layer, a wall situated interiorly to the insulating panel, and a drainage track. The drainage track includes a clog-resistant drainage channel so that water collecting behind the insulating panel may drain from the assembly. The drainage track, in a preferred form, is extruded from PVC and defines a substantially L-shaped configuration in cross-section. An elongated, relatively tall flashing leg is provided for attachment of the drainage track to the wall such that all water-resistant material and insulation laps over the flashing leg to direct water into the drainage channel. Finish apertures are provided through a portion of the drainage track so that exterior finish such as, for example, stucco, will readily adhere and bond to the drainage track.

15 Claims, 4 Drawing Sheets

EXTERIOR WALL ASSEMBLY

This is a continuation in part of application Ser. No. 08/792,597, filed Jan. 31, 1997 U.S. Pat. No. 5,836,135.

BACKGROUND OF THE INVENTION

1. Field of the Invention

The present invention relates to a wall assembly which includes a drainage track of the type primarily intended for use in combination with exterior insulation and finish systems (generally referred to in the construction industry as EIFS), the construction of which provides for positive drainage of moisture which may collect between a structure's exterior surface or coating and its weather-resistant barrier.

2. Description of the Prior Art

In today's construction industry, numerous residential structures, and even a significant number of commercial structures such as, for example, apartment buildings, have their exterior surfaces finished with a stucco-type coating applied over a foam insulation board. One such board is, for example, that disclosed in U.S. Pat. No. 4,572,865, and other such boards are well known in the prior art and in the construction industry. Such exterior finishes are generically referred to as Exterior Insulation and Finish Systems, and will be referred to hereinafter as EIFS.

While such EIFS constructions have proved to be quite satisfactory for their relative ease of installation, their insulating properties, and their ability to receive a variety of aesthetically-pleasing finishes, a serious and vexing problem associated with EIFS construction exists. This problem is one of water accumulation behind the exterior wall covering. Such water may be the result of condensation, but is frequently the result of wind-driven water that may enter behind the exterior wall covering at any point where the exterior surface of the coating is penetrated. Such water accumulation may be the result of poor workmanship or design, deterioration of flashing or sealants over time, lesser quality doors or windows, or any other penetration or compromise of the exterior finish.

When such water penetration or condensation occurs, absent effective, reliable means for draining the water from behind the EIFS exterior construction, structural damage to the building may occur.

The construction industry has certainly recognized such problems associated with water penetration behind EIFS exteriors, and other insulated building components such as, for example, windows. For example, U.S. Pat. No. 4,569,872 describes an insulating window panel which includes a bottom frame member for draining condensation. According to the disclosure of that patent, a transparent plastic sheet having a number of vertical channels formed therethrough is disposed in face-to-face relationship with a polyethylene closed cell foam sheet. The purpose of the vertical channels is to permit water to flow downwardly, and the lower frame member is dimensioned and configured to provide a drain opening along the bottom thereof. This drain opening is provided by insuring that the composite panel is mounted in spaced apart relation to the bottom of the frame member.

U.S. Pat. No. 2,264,961 discloses a thermal insulation structure having vertical channels formed on one face thereof to provide a ventilating space for the circulation of air to dry out water which may penetrate the insulating material. However, this patent does not disclose or suggest any means for positively draining water from inside the wall.

According to the disclosure of U.S. Pat. No. 4,570,398, concrete may be sprayed onto the exterior of rigid sheet insulation and wire to form a continuous waterproof outer surface. However, one may reasonably question such a statement, for concrete is typically permeable to water.

Finally, U.S. Pat. No. 5,511,346 discloses a rigid, thermoplastic foam board useful in below-grade residential and commercial insulating and drainage applications. According to the disclosure of this patent, the board includes a plurality of vertical channels formed therein to provide for water drainage and to protect a below-grade-building wall from excessive moisture.

Without in any way questioning the asserted utility of the devices and structures identified above, any practical study of these devices reveals significant shortcomings. Virtually none of the prior art devices actually provide means for positively draining water away from the building structure. While a drain opening is provided in the panel disclosed by U.S. Pat. No. 4,569,872, establishing that drain opening clearly requires care and precision in fitting the lower frame member to the composite panel. While the other devices discussed above provide means for "ventilating" insulating panels, none provide for water drainage from behind the panels. It is, therefore, clear that there remains a great need in the art of building constructions utilizing EIFS exteriors so as to provide for the drainage of penetrating water or condensing moisture from behind the insulation so as to prevent water-related structural damage to the building. Such a device must not only provide for positive water drainage, but also must be of economical manufacture and of relatively simple use and installation so as not to adversely affect building costs.

SUMMARY OF THE INVENTION

The exterior wall assembly of this invention comprises an outer weather-resistant layer, or coating, a heat insulating panel, situated interiorly to the outer layer, a wall (sheathing) situated interiorily to the insulating panel, and a drainage track, the drainage track being attached at the bottom of and projecting outwardly from the wall, the outward projection of the drainage track supporting the insulating panel and having one or more apertures for removal of water from the wall assembly. This assembly provides for the dispersal of water from the region between the insulating panel and the wall or sheathing, which may, for example, be an OSB board or fiberboard. The drainage track of the exterior wall assembly is of the type primarily intended for use in combination with exterior insulation and finish systems (EIFS). The principal purpose of the drainage track is to provide positive means for draining water from behind the insulating material so as to prevent water-related structural damage to the building. The drainage track comprises a flashing leg by which the track is attached to the exterior wall or sheathing of the building along the bottom edge of that sheathing. A major portion of the flashing leg overlaps the sheathing, and a minor portion of the flashing leg extends below the sheathing's bottom edge. Extending outwardly in angular relation (e.g., perpendicularly) from the bottom edge of the flashing leg is a first structural web. In a preferred embodiment, a second structural web is joined to the first web and extends upwardly in angular relation thereto and advantageously is substantially parallel to the flashing leg. A horizontal leg is joined to the second web and extends in angular relation thereto, outwardly from the flashing leg. Thus, in cross-section, the drainage track defines a substantially L-shaped configuration with a drain channel defined by the lower portion of the flashing leg, the first structural web, and the second structural web. The horizontal leg defines a support surface for placement of an insulating panel thereon. The channel formed between the flashing leg and the horizontal leg has one opening (e.g., a slot) or more than one opening for drainage. A plurality of drain apertures are advantageously formed in the channel to provide for positive drainage of water therefrom.

The exterior wall assembly of the invention includes means for surfacing the insulating panel. The means comprises a weather-resistant layer on the outwardly facing surface of the insulation panel. This layer may be preformed on the insulating panel before final construction of the exterior wall assembly or applied during such construction. The weather-resistant layer is attached to the outwardly projecting horizontal leg of the drainage track. This attachment may be accomplished in various ways, such as by cementing together the two. Advantageously, the cement extends around and exteriorily to the lower portion of the insulating panel and continues uninterruptedly onto the bottom surface of the horizontal leg.

In a further embodiment of the invention, the drainage track, which is preferably plastic, may be variously constructed for attachment, or cementation, to the weather-resistant layer. The horizontal leg can include a variety of means which provide a keyway or holding action to facilitate the attachment. The horizontal leg may be variously shaped for this purpose. A number of projections may extend downwardly from its bottom surface, such as triangles, arrows, rectangles, other ridges, etc. In a preferred embodiment, a plurality of finish apertures are formed through the horizontal leg so as to bring about proper adhesion of the building's exterior weather-resistant layer, or coating, to the lower portion of the wall assembly. In another embodiment, the horizontal leg can also incorporate a combination of shaped projections and apertures for proper adhesion.

Advantageously, the exterior layer is a stucco-type exterior finish, which finish is applied to the exterior surface of the insulating panel according to known procedures and techniques.

In a preferred embodiment, the drainage track is formed from extruded polyvinyl chloride (PVC). However, the scope of the invention is not to be limited to the use of this material. Any suitable material such as, for example, other plastics or metals, may be used for forming the drainage track. In similar fashion, the cross-sectional configuration described above is nothing more than a preferred embodiment, and alternative configurations will be presented hereinafter.

The invention accordingly comprises an exterior wall assembly possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
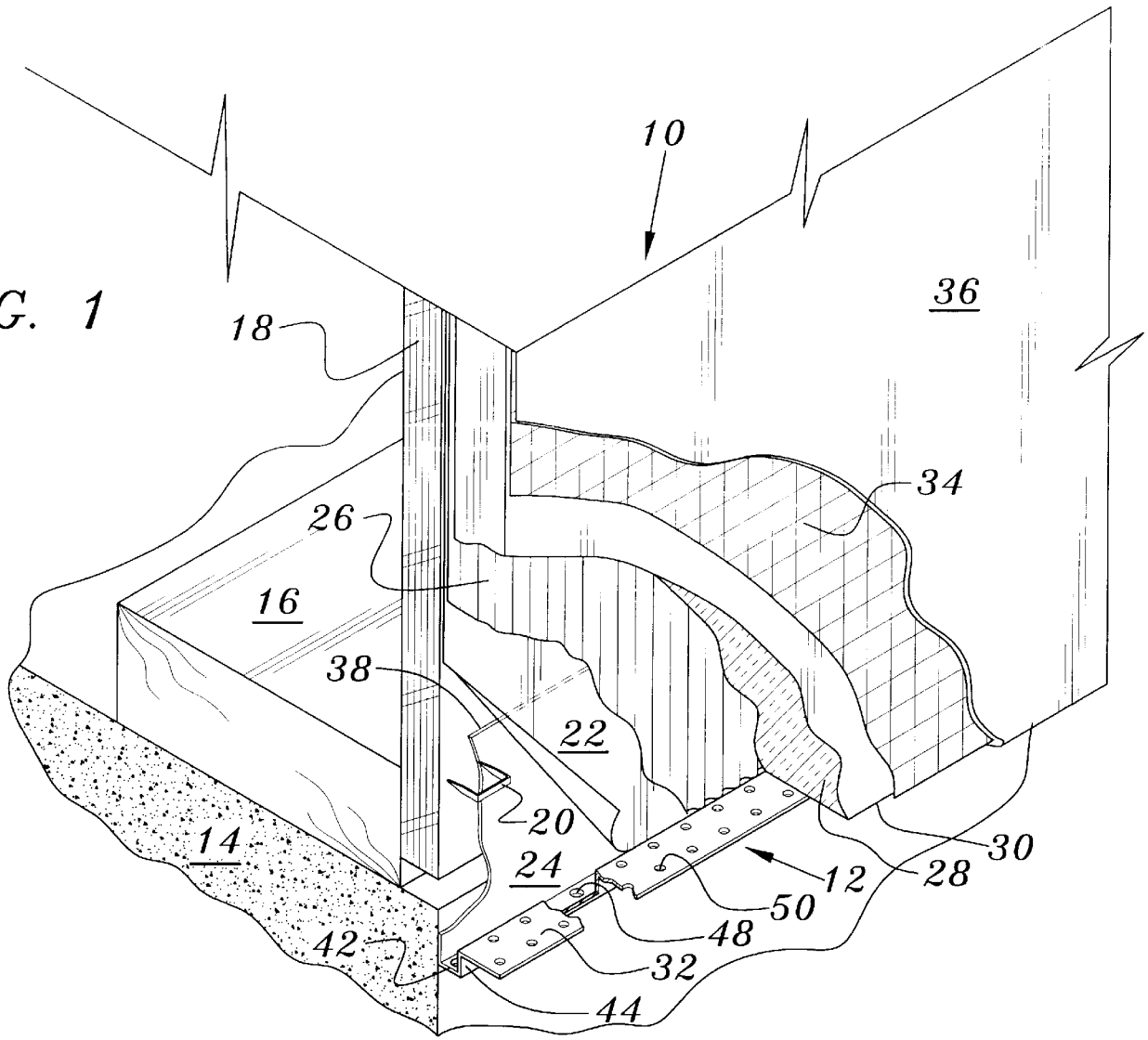
FIG. 1 is a perspective view, partially in section to show interior detail, of an EIFS wall construction showing use and installation of the drainage track of this invention according to a preferred embodiment.
Figure 2:
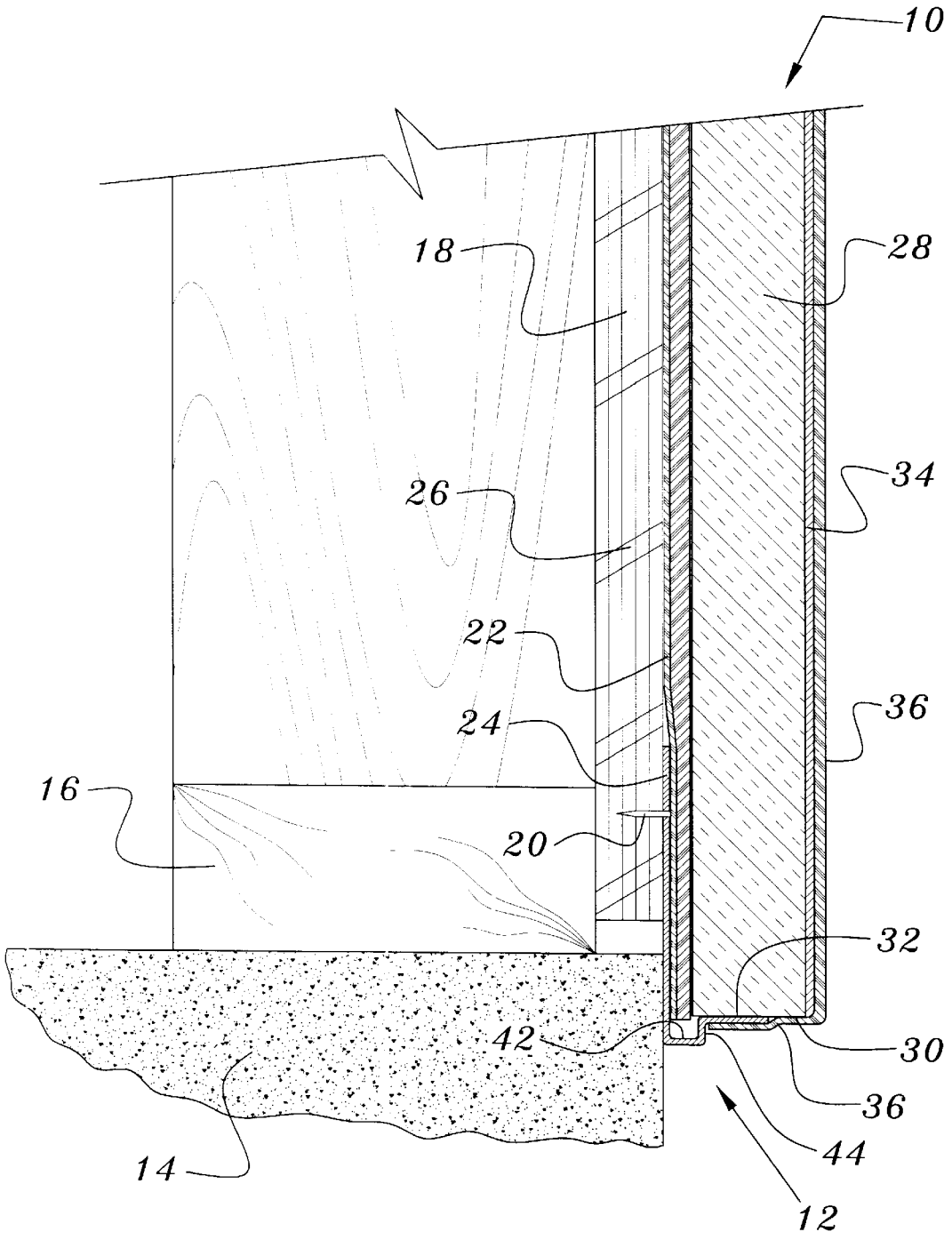
FIG. 2 is a sectional view of the installation shown in FIG. 1.
Figure 4:
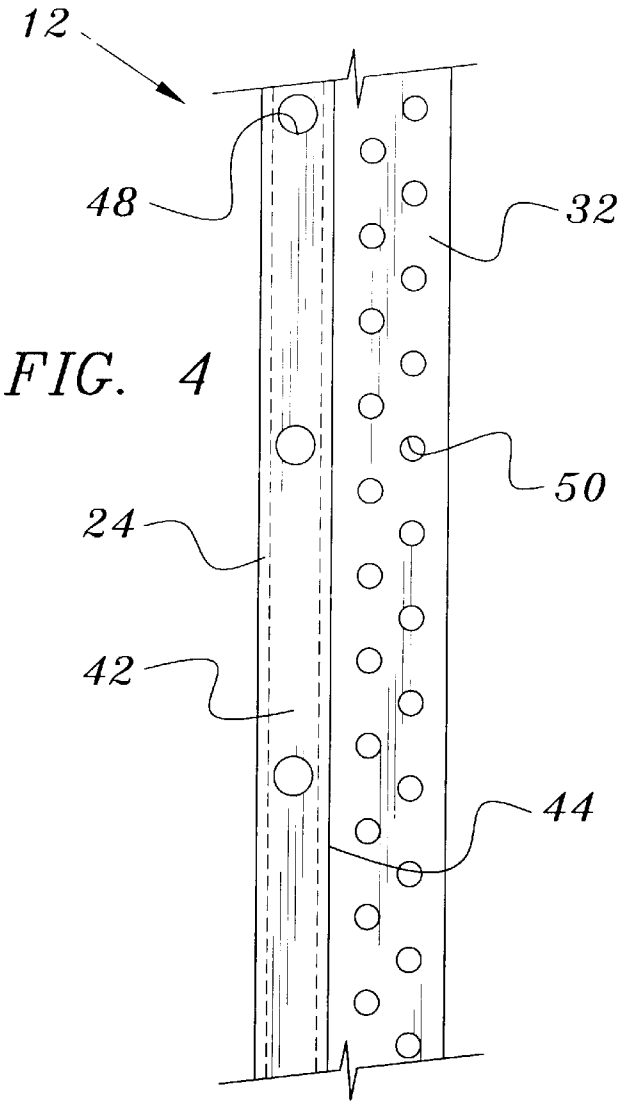
FIG. 4 is a bottom, plan view of the drainage track of FIG. 3.
Figure 3:
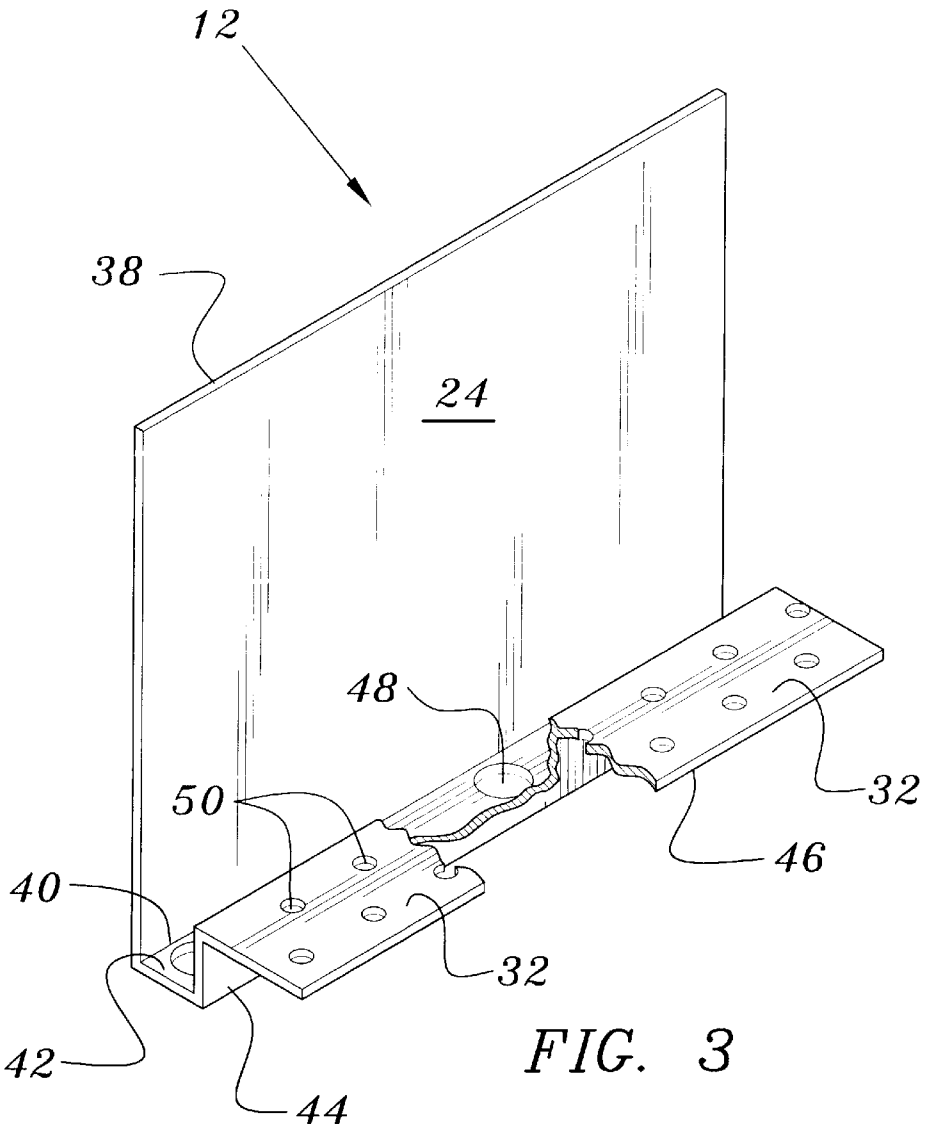
FIG. 3 is a perspective view of a segment of the drainage track used in the installation of FIG. 1.

Referring first to the views of FIGS. 1 and 2, one sees a perspective and a sectional view of a portion of a standard building construction, the exterior of which is finished with an exterior insulation and finish system (EIFS), generally indicated as 10. The drainage track of this invention is generally indicated as 12. The building segment shown in FIGS. 1 and 2 comprises a slab, or foundation, 14 having a sole plate 16 attached thereto. Using studs (not shown), the exterior of the building is initially formed by sheets of sheathing 18. The EIFS 10, in combination with the drainage track 12 of this invention, is actually attached to sheathing 18.

As seen in the view of FIG. 1, drainage track 12 is attached to sheathing 18 as by staples 20, or any such suitable fastening means such as, for example, nails, brads, or screws. Next, a weather resistant barrier 22 is applied over sheathing 18 such that the lower portion of barrier 22 overlaps flashing leg 24 of drainage track 12. Spacers 26 are next applied over barrier 22, and the bottom portion of spacers 26 also overlaps flashing leg 24. Insulating material 28 is next applied. The bottom portion of insulating material 28 also overlaps flashing leg 24. Referring to the view of FIG. 2, it can be seen that the bottom edge 30 of insulating material 28 actually rests on horizontal leg 32 of drainage track 12. The view of FIG. 1 further illustrates that the exterior of insulating material 28 is provided with a reinforcing mesh 34. Finally, the finish coat 36 is applied over the exterior of insulating material 28 and its mesh 34 to complete the installation. Referring to the view of FIG. 2, it can be seen that finish coat 36 actually "wraps around" the bottom edge 30 of insulating material 28 and onto the bottom surface of horizontal leg 32.

Having thus described elements of a standard EIFS installation except for drainage track 12, attention is invited to the fact that the subject matter of this invention is directed to a wall assembly including an exterior insulation and finish system and drainage track 12. That is to say, drainage track 12 is useful in combination with virtually any EIFS 10, and the individual elements of such an exterior finish may certainly vary from job to job. For purposes of example only, weather-resistant barrier 22 is typically a type 15 felt, or an equivalent. Spacers 26 may be 1¼"×3½" closed-cell polyethylene sill sealers, ½" diameter closed-cell backer rods, or their equivalents. Virtually any commerciallyavailable insulating board may be used as the insulating material 28, and the board described in U.S. Pat. No. 4,572,865 is preferred. The insulating panel is beneficially formed from a polyisocyanurate or polyurethane foam. The finish coat 36 may be any coating/sealant as specified for application to and compatibility with insulating material 28. Sheathing 18 may be plywood, gypsum, cement board, fiberboard, OSB board, or other equivalents therefor. It is to be understood that local conditions and building codes will, at least to some extent, dictate the individual components of EIFS 10.

Having thus described a typical EIFS 10 used in combination with drainage track 12 of this invention, attention is now invited to the views of FIGS. 3–6 for a more detailed description of a preferred construction for drainage track 12. As previously indicated, drainage track 12 is preferably extruded from PVC. However, drainage track 12 may be formed from any suitable, substantially rigid material such as, for example, other plastics, other synthetics, or metal. As perhaps best seen in the views of FIGS. 3 and 6, drainage track 12 comprises a flashing leg 24 having a top edge 38 and a bottom edge 40. A first structural web 42 is joined to bottom edge 40 and extends in angular relation thereto. In this preferred embodiment, first structural web 42 is substantially normal to flashing leg 24. A second structural web 44 extends from first web 42 in angular relation to first web 42. Again, as shown in this preferred embodiment, second structural web 44 is substantially normal to first structural web 42 and extends upwardly in the direction of top edge 38 such that second structural web 44 is substantially parallel to flashing leg 24. Horizontal leg 32 is joined to the top of second web 44 and extends in angular relation to second web 44, terminating in a distal edge 46.

A plurality of drain apertures 48 are formed in spaced apart relation through first structural web 42. In a preferred embodiment, a plurality of finish apertures 50 are formed in spaced apart relation through horizontal leg 32.

Figure 6:
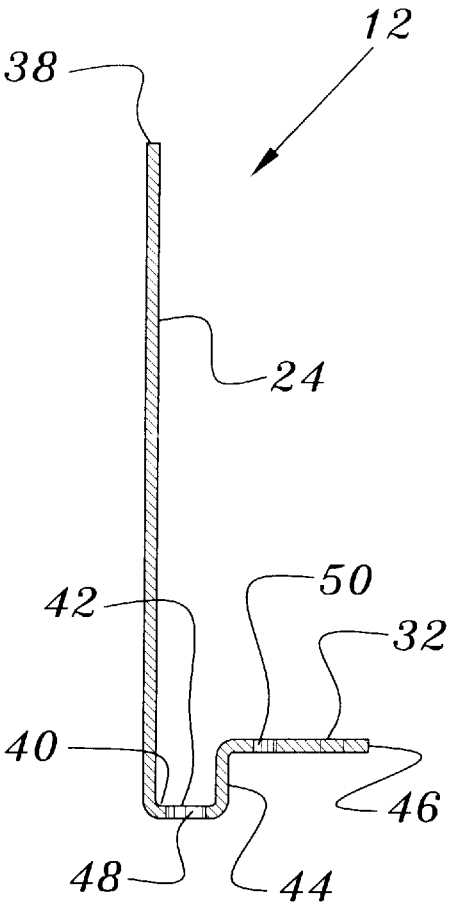
FIG. 6 is a side sectional view of the drainage track of FIG. 3.
Figure 5:
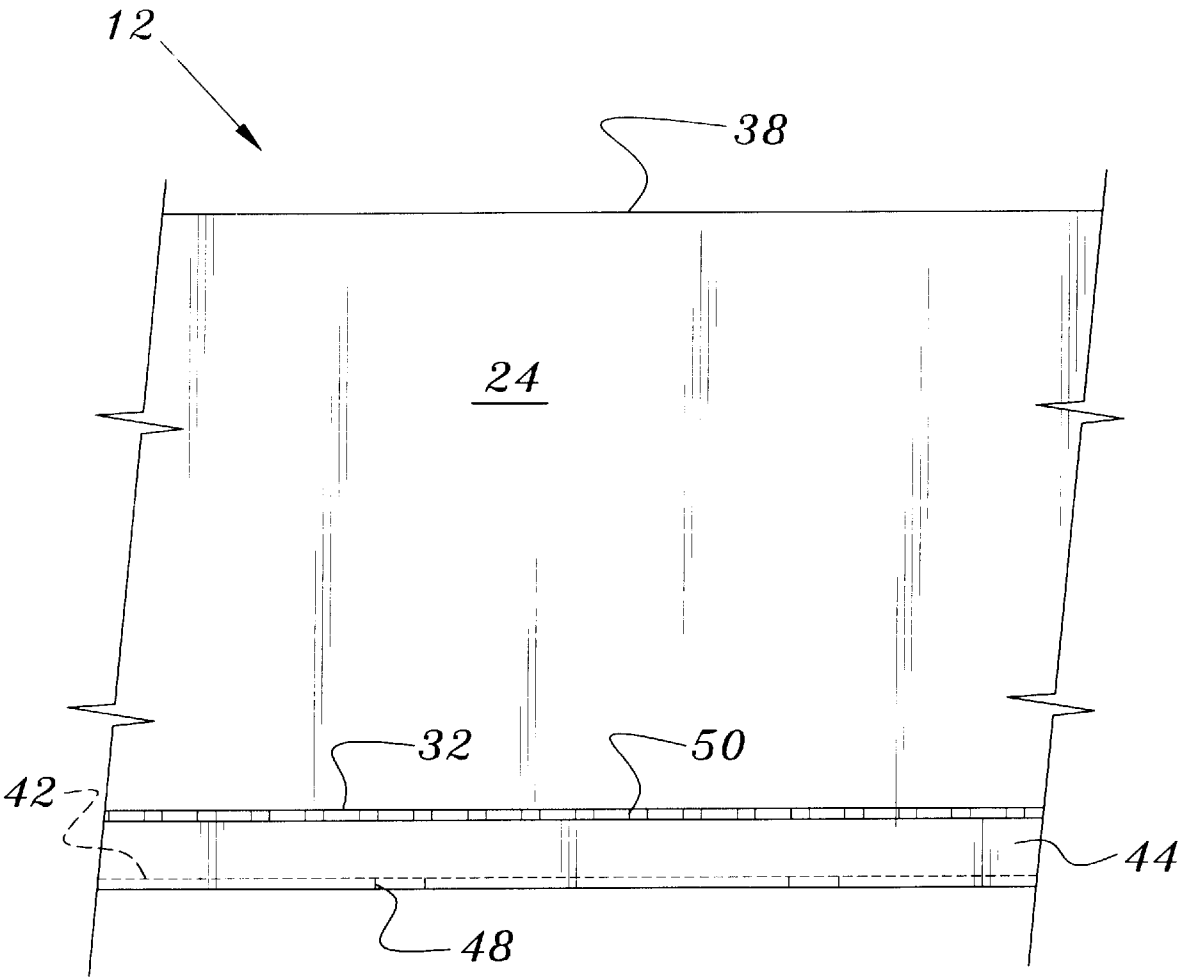
FIG. 5 is a front elevation of the drainage track of FIG. 3.

Referring to the sectional view of FIG. 6 and the sectional installation view of FIG. 2, it can be seen that a portion of flashing leg 24 adjacent bottom edge 40, first structural web 42, and second structural web 44 effectively define a drain channel for positively draining any water that penetrates the EIFS 10 or that condenses therebehind. Referring to the view of FIG. 2, the top of this drain channel is actually defined by bottom edge 30 of insulating material 28, inasmuch as that bottom edge 30 rests on horizontal leg 32.

In the preferred embodiment, drain apertures 48 are about 3/16" in diameter, and finish apertures 50 are about 1/8" in diameter. This size for drain apertures 48 ensures that water will pass therethrough and not be retained in the drain channel as by surface tension, while is of a sufficiently small size to prevent the entry of pests. The smaller size and greater number of finish apertures 50 provide for effective bonding of the finish coat 36 to horizontal leg 32. Though not shown in the drawings, it may be desirable to form the bottom surface of horizontal leg 32 with a plurality of ridges, or with a combination of a plurality of apertures 50 and ridges to further enhance the bonding between horizontal leg 32 and finish coat 36.

It should also be noted that the distance between flashing leg 24 and second web 44 plus the distance defined between second web 44 and distal edge 46 are less than the thickness of the EIFS 10 used in combination with drainage track 12. Thus, a variety of EIFS 10 constructions may be used in combination with a single drainage track 12 so long as the exterior of the insulating material 28 extends beyond distal edge 46.

As indicated above, this construction for drainage track 12, as heretofore described and as shown in the drawing figures, is but a preferred embodiment. First structural web 42 need not necessarily be normal to the plane defined by flashing leg 24, and second structural web 44 need not necessarily be normal to the plane defined by first structural web 42. For example, first web 42 and second web 44 could define a V-shaped drain channel, rather than the substantially rectangular channel shown in the sectional view of FIG. 6. The scope of this invention is intended to encompass such a construction, and drain apertures 48 might then be said to be formed through both the first structural web and the second structural web. In similar fashion, the shapes of first web 42 and second web 44 might be altered to define a curved, substantially U-shaped drain channel with drain apertures formed through the bottom of the U. In all instances, however, flashing leg 24 is attached to the building such that the entire EIFS 10 overlaps top edge 38 of flashing leg 24 so that water will necessarily be directed toward the drain apertures 48. Similarly, horizontal leg 32 will always be spaced apart from flashing leg 24 and define a top, planar surface suitable for operatively receiving bottom edge 30 of the insulating material 28.

A key advantage of the drainage track of this invention is that the outer portion of its drainage channel, e.g., structural web 44 of the embodiment shown in the drawings, serves as a block to prevent clogging of the drain apertures. If the drainage track were to simply be an L-shaped device, without an upwardly projecting and blocking member such as web 44, the installer, in applying the coating and reinforcing mesh over the lower edge of the construction, would tend to plug the drainage holes with the coating because there would be no guide limiting how far back his trowel could go. Thus, the track would become ineffective. Structural web 44 or any equivalent step portion therefore plays a key role by serving as a "guide" in limiting how far back the plasterer pushes his trowel with the coating. This guide prevents him from going all the way back to the substrate (slab 14) and filling the vent holes with coating.

It will thus be seen that the objects set forth above, among those made apparent from the preceding description, are efficiently attained, and, since certain changes may be made in the above assembly without departing from the scope of the invention, it is intended that all matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween. Now that the invention has been described,

We claim:

1. An exterior wall assembly which comprises (a) outer weather-resistant layer, (b) a heat insulating panel situated interiorily to the outer layer, (c) a sheathing situated interiorily to the insulating panel, and (d) a drainage track comprising a flashing leg comprising a top edge and a bottom edge, a first structural web joined to the flashing leg and extending in angular relation from the flashing leg bottom edge, a second structural web joined to the first web and extending in angular relation to the first web, and an horizontal leg joined to the second web and extending in angular relation to the second web, the horizontal leg comprising a distal edge opposite the second web, the flashing leg, first web and second web forming a channel between the flashing leg and horizontal leg, the channel comprising one or more drain apertures, the flashing leg being attached to the sheathing with the horizontal leg projecting outwardly from the sheathing and supporting the insulating panel.

2. The exterior wall assembly of claim 1 wherein the outer weather-resistant layer comprises stucco containing a reinforcing membrane.

3. The exterior wall assembly of claim 1 wherein a weatherresistant barrier is applied over and exteriorly to the sheathing, the barrier overlapping the flashing leg, and spacers are applied over and exteriorly to the barrier, the barrier and spacers situated between the sheathing and the insulating panel.

4. The exterior wall assembly of claim 1 wherein a major portion of the flashing leg overlaps the sheathing, and a minor portion of the flashing leg extends below the sheathing.

5. The exterior wall assembly of claim 1 wherein the outer weather-resistant layer extends around and exteriorly to the insulating panel and continues uninterruptedly onto the horizontal leg.

6. The exterior wall assembly of claim 1 wherein the drainage track is formed from a plastic material.

7. The exterior wall assembly of claim 1 wherein the insulating panel is formed from a polyisocyanurate or polyurethane foam.

8. The exterior wall assembly of claim 1 wherein the drainage track comprises: a flashing leg comprising top edge and a bottom edge, a first structural web attached to the bottom edge and extending outwardly therefrom in substantially normal relation to the flashing leg, the first web comprising a plurality of drain apertures formed therein, a second structural web attached to the first web and extending therefrom in substantially normal relation to the first web in the direction of the leg top edge such that the second web is in spaced apart, substantially parallel relation to the flashing leg, and an horizontal leg attached to the second web and extending therefrom in substantially normal relation to the second web, the horizontal leg comprising a distal edge opposite the second web, and the horizontal leg further comprising a plurality of finish apertures formed therein each of the drain apertures defining a first diameter that is greater than a second diameter defined by each of the finish apertures, and a first dimension defined by the first web between the flashing leg and the second web plus a second dimension defined by the horizontal leg between the second web and the distal edge are less than the distance from the sheathing to the weather-resistant layer.

9. The exterior wall assembly of claim 1 wherein the channel formed between the flashing leg and horizontal leg comprises a plurality of drain apertures formed therein.

10. The exterior wall assembly of claim 9 wherein the horizontal leg comprises a plurality of finish apertures formed therein.

11. The exterior wall assembly of claim 10 wherein the drain apertures define a first diameter that is greater than a second diameter defined by the finish apertures.

12. The exterior wall assembly of claim 1 wherein the first web extends in substantially normal relation to the flashing leg.

13. The exterior wall assembly of claim 12 wherein the second web extends in substantially normal relation to the first web in the direction of the leg top edge.

14. The exterior wall assembly of claim 13 wherein the horizontal leg extends in substantially normal relation to the second web away from the flashing leg.

15. The exterior wall assembly of claim 14 wherein a first dimension defined by the first web between the flashing leg and the second web plus a second dimension defined by the horizontal leg between the second web and the distal edge are less than the distance from the sheathing to the weather-resistant layer.

* * * * *